US005252448A

United States Patent [19]

Nishio et al.

[11] Patent Number: 5,252,448

[45] Date of Patent: Oct. 12, 1993

[54] SILVER HALIDE PHOTOGRAPHIC LIGHT SENSITIVE MATERIAL COMPRISING AT LEAST ONE PROTECTIVE LAYER CONTAINING BORON NITRIDE PARTICLES

[75] Inventors: Shiyouji Nishio; Noriyasu Kita; Takashi Shinkai, all of Hino, Japan

[73] Assignee: Konica Corporation, Tokyo, Japan

[21] Appl. No.: 932,894

[22] Filed: Aug. 20, 1992

[30] Foreign Application Priority Data

Sep. 25, 1991 [JP] Japan ..... 3-245913

[51] Int. Cl.[5] ..... G03C 1/76

[52] U.S. Cl. ..... 430/523; 430/950; 430/539

[58] Field of Search ..... 430/950, 523, 539

[56] References Cited

U.S. PATENT DOCUMENTS

| | | | |
|---|---|---|---|
| 2,852,386 | 9/1958 | Tong | 430/628 |
| 3,062,674 | 11/1962 | Houck et al. | 430/537 |
| 3,080,317 | 3/1963 | Tallet et al. | 430/401 |
| 3,142,568 | 7/1964 | Nottorf | 430/535 |
| 3,325,286 | 6/1967 | Nottorf | 430/628 |
| 3,411,911 | 11/1968 | Dykstra | 430/535 |
| 3,411,912 | 11/1968 | Dykstra et al. | 430/535 |
| 3,547,650 | 12/1970 | Pilato | 430/628 |
| 4,047,958 | 9/1977 | Yoneyama et al. | 430/527 |
| 4,740,439 | 4/1988 | Tachikawa et al. | 430/501 |

FOREIGN PATENT DOCUMENTS

| | | |
|---|---|---|
| 1442436 | 2/1969 | Fed. Rep. of Germany . |
| 2138849 | 6/1987 | Japan . |
| 1-255853 | 10/1989 | Japan . |

OTHER PUBLICATIONS

World Patents Index Latest Week 8707, Derwent Publications Ltd., London, GB; AN 87-047457.

*Primary Examiner*—Charles L. Bowers, Jr.
*Assistant Examiner*—Geraldine Letscher
*Attorney, Agent, or Firm*—Frishauf, Holtz, Goodman & Woodward

[57] ABSTRACT

A silver halide light-sensitive material is disclosed, which has an improved sliding ability and antiadhesion property and has good photographic characteristics. The light-sensitive material comprises a support having, on a side of the support, a silver halide emulsion layer and a protective layer provided on the silver halide emulsion layer, and on the other side of the support, a backing layer and a protective layer provided on the backing layer, wherein at least one of the protective layer on the emulsion layer and the protective layer of the backing layer contains particles comprising boron nitride.

15 Claims, No Drawings

SILVER HALIDE PHOTOGRAPHIC LIGHT SENSITIVE MATERIAL COMPRISING AT LEAST ONE PROTECTIVE LAYER CONTAINING BORON NITRIDE PARTICLES

FIELD OF THE INVENTION

This invention relates to a silver halide photographic light sensitive material and particularly to a silver halide photographic light sensitive material improved in photographic characteristics, sliding property and anti-adhering property.

BACKGROUND OF THE INVENTION

A silver halide photographic light sensitive material is generally comprised of a support made of a sheet of glass, paper or plastic-coated paper coated thereon with various combinations of photographic component layers such as light sensitive silver halide emulsion layers and, if required, an interlayer, a protective layer, a backing layer, an antihalation layer and an antistatic layer. Such a photographic light sensitive material as mentioned above is often unfavorably affected, for example, in the preparation steps such as the coating, drying and processing steps, in the portions where the light sensitive material is brought into contact with various equipment, machines and cameras when the light sensitive material is wound up, rewound or transported in the courses of carrying out the photographing, developing, printing and projecting steps, or the light sensitive materials are brought into frictional contact with each other, such as the frictional contact of the light sensitive surfaces of the light sensitive materials with the backing surfaces thereof. The above-mentioned unfavorable influences include, for example, a scratch or abrasion produced on the surfaces of a light sensitive material, and the driven property deterioration of a light sensitive material produced in the equipment or mechanisms used in the courses of making exposures or treating the light sensitive material.

Various proposals have so far been made for the methods of preparing photographic light sensitive materials improved in the physical properties thereof by enhancing the scratch resistance of the photographic component layers of the light sensitive materials or by reducing the sliding friction so as to make freely movable a film cassette and the camera- or printing-gates such as a camera gate and a projector gate, without damaging any photographic component layers. The known examples of the above-mentioned proposals include; a method such as described in U.S. Pat. No. 3,042,522 in which the sliding ability is provided to a photographic film by containing both dimethyl silicone and a specific surfactant at the same time in the photographic emulsion layer or the protective layer thereof; another method such as described in U.S. Pat. No. 3,080,317 in which a sliding ability is provided to a photographic film by coating a mixture of dimethyl silicone and diphenyl silicone on the back surface of the film; a further method such as described in U.S. Pat. No. 1,143,118 in which a sliding ability is provided to a photographic film by containing methyl-phenyl silicone with the triphenyl-blocked terminal in a protective layer; and a still further method such as described in U.S. Pat. No. 3,489,567 in which a photographic light-sensitive material having a sliding ability and an antiadhesion property is provided by containing both lower dialkyl silicone and a $\beta$-alanine type surfactant in the photographic emulsion layers or other hydrophilic colloidal layers thereof.

However, when trying to improve the physical properties of a photographic light sensitive material in these known methods, any adhesiveness of surface has not been completely removed, though the sliding ability and other properties may be improved to some extent.

When an excellent sliding ability is to be provided, a large amount of silicone must be used, whereby defects may be induced, for example, the coating characteristics may be affected in the course of preparing a photographic light sensitive material or a liquid splattering may be produced to interfere with development, because the silicone used therein has a little effect of providing a sliding ability.

For remedying the above-mentioned defects, there are a method in which alkyl polysiloxane having a polyoxyalkylene chain is used as mentioned in, for example, U.S. Pat. No. 4,047,958 and another method in which liquid organopolysiloxane having an alkyl group having not less than 5 carbon atoms is used as mentioned in, for example, Japanese Patent (hereinafter referred to as JP) Examined Publication No. 53-292/1978. However, when the above-mentioned methods are applied to a backing layer in particular, there may be some instances where silicone added thereto may affect a photographic emulsion when the emulsion is coated, so that various coating characteristics may be spoiled, though these methods may display a considerable effect to improve some kind of the defects. There have also been some instances where the running properties of a processed film have been deteriorated on a transport roller or in a camera. As for the methods for avoiding the above-mentioned defects, a method is disclosed in, for example, U.S. Pat. No. 4,404,276, in which a cross-linked silicone is used.

However, when the above-mentioned physical properties are tried to improve in the above-mentioned methods, any effects have not satisfactorily been displayed for improving the coating characteristics, though the sliding property may be maintained after completing a development.

JP Examined Publication Nos. 60-140341/1985 and 2-153344/1990 disclose the methods in which the partially changed structures of organosiloxane were used. Even in these methods, there is some limitation to silicones to improve the sliding property. Recently, the transport rates of an exposure equipment and the processing rates of an automatic processor have been getting far increased and, therefore, the improvements of the sliding property have been further required.

Particularly in light sensitive materials for photomechanical use, the influences of any scratches are emphasized, because theese light sensitive materials are hard in contrast.

In the light sensitive materials for photomechanical use, on the other hand, JP Publication Open to Public Inspection (hereinafter referred to as JP OPI Publication) No. 58-190949/1983, for example, discloses a technique in which a surfactant comprising polyalkylene oxide is used as an emulsion contrast increasing agent when using a stable developer containing a preservative such as sodium sulfite. However, when making combination use of the polyalkylene oxide and various matting agents such as the fine particles of silica or macromolecules, a large number of pin-holes are produced on the edges of a printing light sensitive material so that the print quality may seriously be spoiled.

For the measure to counter a pin-hole production, the polyalkylene oxides different from the above-mentioned have been developed, such as those described in JP OPI Publication No. 62-6250/1987. The pin-hole trouble was eliminated thereby, but the other problems still remain unsolved, namely, the problems of spoiling degradation in a contrast and an image sharpness. For solving the problems, it has been demanded for a protective layer having a quite different surface matting agent from any conventional matting agents.

SUMMARY OF THE INVENTION

For solving the above-mentioned problems, it is an object of the invention to provide a silver halide photographic light sensitive material greatly improved in adhering and sliding properties without suffering any physical coating property.

Another object of the invention is to provide a highly sensitive silver halide photographic light sensitive material for printing use without producing any pin-holes but with providing an ultra-hard contrast, a sufficient image sharpness, a satisfactory pressure resistance and a surface matting property.

The above-objects of the invention can be achieved with a silver halide photographic light-sensitive material comprising a support having, on a side of the support, a silver halide emulsion layer and a protective layer provided on the silver halide emulsion layer, and on the other side of the support, a backing layer and a protective layer provided on the backing layer. At least one of the emulsion layer side and backing layer side protective layers contains particles comprising boron nitride.

In an embodiment of the invention, it is preferable that the emulsion layer comprises cubic silver halide grains having (100) faces which is prepared under a condition with a pH value of 5 to 7 and a polyalkylene oxide compound. The silver halide grains have a silver chloride content of not less than 50 mol % and an average size of not more than 0.5 μm.

DETAILED DESCRIPTION OF THE INVENTION

In the invention, for the purposes of improving a close-contact property, an antiadhesion property, an antiscratching property, a sliding ability and a front-and-back surface discrimination property without producing any pin-holes, boron nitride is used as the matting agent. From the viewpoints of effectively making the matting property and antiadhesion property with lowered haze, the average particle size of the boron nitride matting agent is to be within the range of, desirably, 1 to 10 μm and, preferably, 2 to 5 μm. Boron nitride provides a tabular-shaped transparent crystals having hexagonal graphite structure and it is insoluble to water and an organic solvent. Boron nitride does not produce any physical adsorption, because the surface of the particle of which is inert. Therefore, with silica particles having conventionally been used as a matting agent, the polyalkylene oxide compounds having been used as a contrast increaser are adsorbed to inhibit a development, so that pin-holes may resultingly be produced. On the other hand, with the above-mentioned boron nitride, no pin-hole can be produced, because no adsorption can be produced. With the matting agents such as polymer particles typified by polymethyl methacrylate, pin-holes are produced by the lens-effect of the particles themselves. With boron nitride, on the other hand, no pin-hole can be produced, because it has the tabular-shaped structure. In the case of boron nitride, any problems of the conventional matting agents cannot be raised.

Boron nitride applicable to the invention is added into a hydrophilic colloidal layer to be provided as a protective layer on a silver halide emulsion layer or a backing layer. Boron nitride may be added into a hydrophilic colloidal layer by adding directly into a coating solution for forming the hydrophilic colloidal layer or it may be dispersed in water, an organic solvent, a gelatin solution, a viscosity controller solution, a surfactant solution or the combination solution thereof and the resulting dispersed solution may be added into the coating solution. Boron nitride may be added in a proportion within the range of, desirably, 5 to 1000 mg/m$^2$, preferably, 20 to 200 mg/m$^2$, more preferably 50 to 80 mg/m$^2$ after coating. The boron nitride such as those mentioned above are readily be available as a commercial product from Kawasaki Steel Co., Ltd., for example. Boron nitride can display the effects independently as a matting agent. However, if desired, polymer particles such as those of silica or polymethyl methacrylate may also be used for.

The polyalkylene oxides applicable to the invention are each represented by the following Formulas I and II and they may be used independently or in combination.

Formula I $$HO(CH_2CH_2O)_{n1}(CH_2\underset{\underset{CH_2OR_1}{|}}{CHO})_{m1}(R_2O)_l(CH_2\underset{\underset{CH_2OR_1}{|}}{CHO})_{m2}(CH_2CH_2O)_{n2}H$$

wherein $R_1$ represents an alkyl group having 2 to 4 carbon atoms; $R_2$ represents an alkylene group having 2 to 4 carbon atoms; l represents 0 to 5; m1+m2 represents 2 to 20; and $n_1+n_2$ represents 5 to 50.

Formula II $\quad R_3-A-O(CH_2CH_2O)_nH$ wherein $R_3$ represents an alkyl group having 6 to 30 carbon atoms; A represents a substituent other than $R_3$ or an aromatic ring which may have further substituent other than $R_3$; and n represents an integer of 13 to 50.

In Formula I, the alkyl groups each having 2 to 4 carbon atoms, represented by $R_1$, include, for example, $-CH_2CH_3$, $$-CH_2CH_2CH_3,\ -CH\begin{matrix}\diagup CH_3\\ \diagdown CH_3\end{matrix},\ -CH_2CH_2CH_2CH_3 \text{ and}$$

$$-\underset{\underset{CH_3}{|}}{CH}CH_2CH_3; \text{ and the}$$

alkylene groups each having 2 to 4 carbon atoms include, for example, $$-CH_2CH_2-,\ -CH_2\underset{\underset{CH_3}{|}}{CH}-,\ -CH_2CH_2CH_2-,$$

-continued $$-CH_2CH_2CH_2CH_2-,\ -CH_2\underset{\underset{CH_3}{|}}{\overset{\overset{CH_3}{|}}{C}}H-\ \text{and}\ -CH_2CH_2\underset{\underset{CH_3}{|}}{C}H-.$$

When the compounds of formula I and formula II are used in combination, the proportions of the compounds represented by Formula [I] to the compounds represented by Formula [II] each used therein are within the ranges of [I]:[II]=20:80 to 80:20 and, preferably, 30:70 to 20:30.

The typical examples of the compounds represented by Formula [I] each applicable to the invention will now be given below.

I-1:

$$HO(CH_2CH_2O)_{n1}(\underset{\underset{CH_2OC_2H_5}{|}}{CH_2CHO})_m(CH_2CH_2O)_{n2}H$$

wherein l = 0, m = 12, n1 + n2 = 20

I-2:

$$HO(CH_2CH_2O)_{n1}(\underset{\underset{CH_2OC_2H_5}{|}}{CH_2CHO})_{m1}(CH_2CH_2O)_l(\underset{\underset{CH_2OC_2H_5}{|}}{CH_2CHO})_{m2}(CH_2CH_2O)_{n2}H$$

wherein l = 1, m1 + m2 = 15, n1 + n2 = 30

I-3:

$$HO(CH_2CH_2O)_{n1}(\underset{\underset{CH_2OC_2H_5}{|}}{CH_2CHO})_{m1}(\underset{\underset{CH_3}{|}}{CH_2COH})_l(\underset{\underset{CH_2OC_2H_5}{|}}{CH_2CHO})_{m2}(CH_2CH_2O)_{n2}H$$

whrerein l = 1, m1 + m2 = 12, n1 + n2 = 25

I-4:

$$HO(CH_2CH_2O)_{n1}(\underset{\underset{CH_2OC_2H_5}{|}}{CH_2CHO})_{m1}(\underset{\underset{CH_3}{|}}{CH_2CHO})_l(\underset{\underset{CH_2OC_2H_5}{|}}{CH_2CHO})_{m2}(CH_2CH_2O)_{n2}H$$

wherein l = 1, m1 + m2 = 16, n1 + n2 = 40

I-5:

$$HO(CH_2CH_2O)_{n1}(\underset{\underset{CH_2OC_2H_5}{|}}{CH_2CHO})_{m1}(\underset{\underset{CH_3}{|}}{CH_2CH_2CHO})_l(\underset{\underset{CH_2OC_2H_5}{|}}{CH_2CHO})_{m2}(CH_2CH_2O)_{n2}H$$

wherein l = 3, m1 + m2 = 5, n1 + n2 = 15

I-6:

$$HO(CH_2CH_2O)_{n1}(\underset{\underset{CH_2OC_3H_7}{|}}{CH_2CHO})_m(CH_2CH_2O)_{n2}H$$

wherein l = 0, m = 10, n1 + n2 = 25

I-7:

$$HO(CH_2CH_2O)_{n1}(\underset{\underset{CH_2OC_3H_7}{|}}{CH_2CHO})_{m1}(\underset{\underset{CH_3}{|}}{CH_2CHO})_l(\underset{\underset{CH_2OC_3H_7}{|}}{CH_2CHO})_{m2}(CH_2CH_2O)_{n2}H$$

wherein l = 1, m1 + m2 = 8, n1 + n2 = 20

I-8:

$$HO(CH_2CH_2O)_{n1}(\underset{\underset{CH_2OC_3H_7}{|}}{CH_2CHO})_{m1}(CH_2CH_2CH_2O)_l(\underset{\underset{CH_2OC_3H_7}{|}}{CH_2CHO})_{m2}(CH_2CH_2O)_{n2}H$$

wherein l = 1, m1 + m2 = 14, n1 + n2 = 35

I-9:

$$HO(CH_2CH_2O)_{n1}(\underset{\underset{CH_2OC_3H_7(iso)}{|}}{CH_2CHO})_m(CH_2CH_2O)_{n2}H$$

wherein l = 0, m = 8, n1 + n2 = 20

I-10:

$$HO(CH_2CH_2O)_{n1}(\underset{\underset{CH_2OC_3H_7(iso)}{|}}{CH_2CHO})_m(CH_2CH_2O)_{n2}H$$

wherein l = 0, m = 12, n1 + n2 = 30

I-11:

$$HO(CH_2CH_2O)_{n1}(\underset{\underset{CH_2OC_3H_7(iso)}{|}}{CH_2CHO})_{m1}(CH_2CH_2O)_l(\underset{\underset{CH_2OC_3H_7(iso)}{|}}{CH_2CHO})_{m2}(CH_2CH_2O)_{n2}H$$

wherein l = 1, m1 + m2 = 8, n1 + n2 = 20

I-12:

$$HO(CH_2CH_2O)_{n1}(\underset{\underset{CH_2OC_3H_7(iso)}{|}}{CH_2CHO})_{m1}(CH_2CH_2O)_l(\underset{\underset{CH_2OC_3H_7(iso)}{|}}{CH_2CHO})_{m2}(CH_2CH_2O)_{n2}H$$

wherein l = 5, m1 + m2 = 10, n1 + n2 = 20

I-13:

$$HO(CH_2CH_2O)_{n1}(\underset{\underset{CH_2OC_3H_7(iso)}{|}}{CH_2CHO})_{m1}(\underset{\underset{CH_3}{\backslash}}{CH_2CHO})_l(\underset{\underset{CH_2OC_3H_7(iso)}{|}}{CH_2CHO})_{m2}(CH_2CH_2O)_{n2}H$$

wherein l = 1, m1 + m2 = 10, n1 + n2 = 25

I-14:

$$HO(CH_2CH_2O)_{n1}(\underset{\underset{CH_2OC_4H_9(n)}{|}}{CH_2CHO})_m(CH_2CH_2O)_{n2}H$$

wherein l = 0, m = 5, n1 + n2 = 15

-continued

I-15:

$$HO(CH_2CH_2O)_{n1}(CH_2\underset{\underset{CH_2OC_4H_9}{|}}{C}HO)_m(CH_2CH_2O)_{n2}H$$

wherein l = 0, m = 9, n1 + n2 = 25

I-16:

$$HO(CH_2CH_2O)_{n1}(CH_2\underset{\underset{CH_2OC_4H_9(n)}{|}}{C}HO)_{m1}(CH_2\underset{\underset{CH_3}{|}}{C}HO)_l(CH_2\underset{\underset{CH_2OC_4H_9(n)}{|}}{C}HO)_{m2}(CH_2CH_2O)_{n2}H$$

wherein l = 1, m1 + m2 = 7, n1 + n2 = 20

I-17:

$$HO(CH_2CH_2O)_{n1}(CH_2CHO)_{m1}(CH_2\underset{\underset{CH_2OC_4H_9(n)}{|}}{C}H_2CH_2CH_2O)_l(CH_2CHO)_{m2}(CH_2\underset{\underset{CH_2OC_4H_9(n)}{|}}{C}H_2O)_{n2}H$$

wherein l = 4, m1 + m2 = 10, n1 + n2 = 50

I-18:

$$HO(CH_2CH_2O)_{n1}(CH_2\underset{\underset{CH_2OC_4H_9(sec)}{|}}{C}HO)_m(CH_2CH_2O)_{n2}H$$

wherein l = 0, m = 7, n1 + n2 = 20

I-19:

$$HO(CH_2CH_2O)_{n1}(CH_2\underset{\underset{CH_2OC_4H_9(sec)}{|}}{C}HO)_{m1}(CH_2CH_2O)_l(CH_2\underset{\underset{CH_2OC_4H_9(sec)}{|}}{C}HO)_{m2}(CH_2CH_2O)_{n2}H$$

wherein l = 4, m1 + m2 = 10, n1 + n2 = 25

The above-given compounds may readily be synthesized in accordance with the process described in, for example, JP OPI Publication No. 56-30124/1981.

The amounts of adding the compounds represented by Formula I applicable to the invention (hereinafter referred to as Compounds I) and the layers containing them will be detailed.

Any one of the component layers of a light sensitive material and, preferably, a silver halide emulsion layer and/or a layer adjacent thereto may be served as the above-mentioned layers containing Compound I. Compounds I may be contained in a light sensitive material in such a manner that Compound I is dissolved in water, an organic solvent miscible to water or the mixed solution thereof and the resulting solution is desirably added into a coating solution for forming a silver halide emulsion layer and/or a layer adjacent to the silver halide emulsion layer and preferably added into the silver halide emulsion layer.

Compound I may be added in an amount within the range of, desirably, 25 mg to 5 g per mol of silver halide used and, preferably, 25 mg to 2 g. The point of time when adding Compound I may be freely selected in the course of preparing a light sensitive material. When adding it into a silver halide emulsion layer, for example, it is preferred to add it after completing the second ripening treatment.

It is also effective to contain Compound I in a lith developer. In this case, Compound I may be added in an amount of 50 mg to 10 g per liter of the developer.

The typical examples of the compounds represented by Formula II, each applicable to the invention, will be given below.

[Exemplified compounds]

II-1

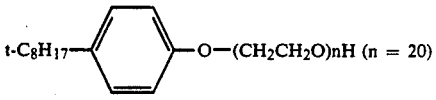

II-2

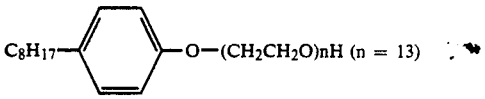

-continued

[Exemplified compounds]

II-3

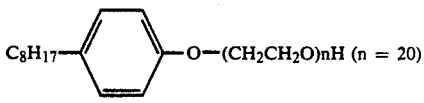

II-4

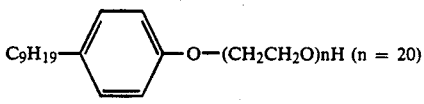

II-5

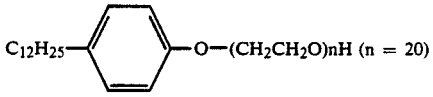

II-6

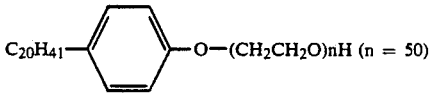

II-7

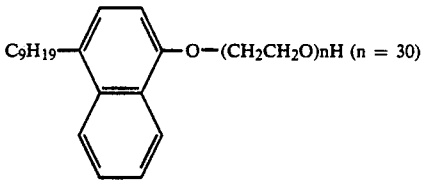

II-8

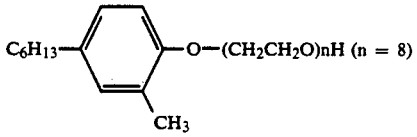

II-9

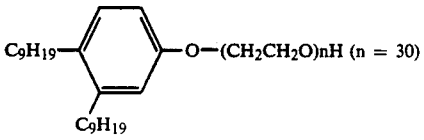

II-10

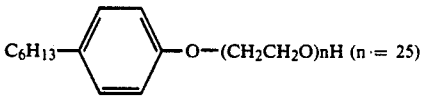

-continued

[Exemplified compounds]

II-11

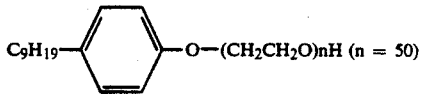

In the light sensitive materials of the invention, polyalkylene oxide compounds represented by Formula II may also be added into any one of the layers constituting a hydrophilic colloidal layer. The amounts added them may be varied depending on the layers subject to be added. However, it is generally preferred to add them more when they are added to a layer more closer to the surface of a silver halide emulsion layer. When adding them to a silver halide emulsion layer, they are added in an amount of, preferably, 6 mg to 6 g per mol of silver usually contained in the emulsion layer.

In the invention, a silver halide emulsion having a silver chloride content of not less than 50 mol % and an average grain size of not more than 0.5 μm.

The conventional techniques may be appropriated to the silver halide emulsions relating to the invention. To be more concrete, the emulsion preparation methods may be selected from any one of an acid method, a neutral method and an ammoniacal method. The silver halide grains may be formed or embodied in any one of the methods, namely; a normal precipitation method in which a halide solution is added into a silver salt solution and the solutions vice versa; a reverse precipitation method; a double-jet precipitation method in which the above-mentioned two kinds of the solutions are simultaneously added; and a controlled double-jet precipitation method in which the controls are finely performed. It is also allowed that a halogen composition is changed in a conversion method after growing grains. It is further allowed to add the salt of Cd, Zn, Fe, Pb, Tl or Ir, the complex salts thereof, or Rh salt or the complex salts thereof in the course of growing the grains so that the inside and/or surfaces of the grains may be doped. In the above-mentioned a silver halide emulsion prepared under a condition with a pH value of 5 to 7 is preferably used in the invention.

The crystallographic configurations of emulsion grains may have any crystal forms taken by silver halides or the mixed crystals thereof. The crystal forms may be specified within a considerable wide range by using a crystal form controller and may also take a twinned crystal form. Further, the crystal forms may have a peculiar crystal habit. Or, the crystal forms may also have an etching-figure on the crystal faces by making use of a silver halide solvent. A preferable emulsion of the invention comprises cubic silver halide grains having (III) crystal faces.

The internal structure of emulsion grains may be provided with a core/shell structure comprising the shell layers having a uniform composition distribution or a different composition from each other layer and a light sensitive nucleus may also be produced inside and/or on the surface of each grain.

The grain size distribution of the emulsion grains may be either polydispersive or monodispersive. It is further allowed to mixe up two or more kinds of grains separately prepared so as to make a mixture of either some kinds of monodispersed grains or polydispersed grains, or a mixture of monodispersed grains and polydispersed grains.

From the resulting silver halide emulsions, any disused soluble salts may be removed after completing the growth of the silver halide grains or the disused salts are allowed to remain as they are. When removing the salts, the removals thereof may be carried out in accordance with the method described in, for example, Research Disclosure No. 17643.

The silver halide emulsions relating to the invention may be chemically sensitized in any ordinary methods. To be more concrete, the chemical sensitization may be carried out in a sulfur sensitizing method, a selenium sensitizing method, a reduction sensitizing method and a noble-metal sensitizing method in which gold or other noble metal compounds are used independently or in combination.

The silver halide emulsions relating to the invention may be optically sensitized to any desired wavelength regions by making use of the dyes such as a cyanine dye and a melocyanine dye which are so-called the sensitizing dyes known in the field of the photographic art. The above-mentioned sensitizing dyes may be used independently. However, they may also be used in combination. The sensitizing dyes may be added in the course of forming and/or growing the silver halide grains, in the course of chemically ripening the grains and/or after completing the chemical ripening treatment. The emulsions are also allowed to contain not only the sensitizing dyes, but also a dye not having any spectral sensitization fuction in itself or a compound substantially incapable of absorbing any visible rays of light, which is so-called a supersensitizer for enhancing the sensitizing function of the sensitizing dyes.

In the invention, it is also allowed to apply a variety of additives applicable to the photographic treatments. To be more concrete, for the purposes of preventing any fog production or keeping the photographic characteristics stable in the courses of preparing, storing or photographically treating a light sensitive material, a compound known as an antifoggant or a stabilizer may be added at the point of time when carrying out or completing a chemical ripening treatment and/or at any point of time between the time when completing the chemical ripening treatment and the time when a silver halide emulsion is coated. It is allowed to use the well-known antifoggants and stabilizers including, for example, azaindenes such as, typically, 4-hydroxy-6-methyl-1,3,3a,7-tetrazaindene, thiazoles, triazoles and tetrazoles.

There is no special limitation to the development accelerators applicable thereto. However, the compounds given in, for example, JP OPI Publication No. 49-24427/1974 and quaternary ammonium salts may be used for.

The photographic emulsion layers and other hydrophilic colloidal layers may be hardened by cross-coupling the molecules of binders thereto and then by using one or not less than two kinds of layer hardeners for enhancing the layer hardness. The layer hardeners may be added in such an amount as not needed to add any further layer hardeners in any processing solutions, but as is capable of hardening the layers of a light sensitive material. Besides the above, such a layer hardener may also be added in the processing solutions.

For example, it is allowed to use an aldehyde type compound, a ketone compound, a halogen-substituted acid such as mucochloric acid, a halotriazine type compound, an epoxy type compound, an ethyleneimine type compound, a vinylsulfone type compound and an acryloyl type compound.

Further, for the purpose of preventing any electrostaticity, an antistatic agent may be added. The antistatic agent may be used in an antistatic layer on the side of the support where no emulsion is coated and, the antistatic agent may also be used in an emulsion layer and/or a protective colloidal layer other than the emulsion layer coated on the side of the support. Besides the above, for the purposes of improving a sliding ability, preventing any adhesion, improving the photographic characteristics, such as a development acceleration, layer hardening and sensitization, improving a coatability and performing an emulsification dispersion, a variety of surfactants may also be used in other emulsion layers and/or other hydrophilic colloidal layers. For example, saponin and lauryl or oleyl monoether of polyethylene glycol may be used therein.

The light sensitive materials of the invention may be provided with such an auxiliary layer as a filter layer, an antihalation layer and/or an anti-irradiation layer. These layers and/or the emulsion layers are allowed to contain a dye capable of flowing out of a light sensitive material or being decolored, in the course of a developing treatment. When containing a dye in a hydrophilic colloidal layer, the dye may also be mordanted with a mordant such as a cationic polymer.

As for the binders, or the protective colloids, for the silver halide emulsions relating to the invention, gelatin may be advatageously used. Gelatin is also allowed to make combination use with a hydrophilic colloid including, for example, a gelatin derivative, a graft polymer of gelatin and the other macromolecules, proteins other than the above, a sugar derivative, a cellulose derivative and a synthesized hydrophilic macromolecular material such as those of a monomer or a copolymer.

For the purpose of enhancing the softness of the above-mentioned hydrophilic colloidal layers, the colloidal layers may be added with a plasticizer or a thickener for controlling the coatability.

For the purposes of improving a dimensional stability and so forth, the emulsion layers and other hydrophilic colloidal layers each relating to the invention are allowed to contain the dispersed matters, or the latexes, of a water-insoluble or hardly soluble synthetic polymer. For example, JP Examined Publication Nos. 45-5,331/1970 and 46-22,506/1971; JP OPI Publication Nos. 49-74,538/1974 and 55-25,077/1980; and U.S. Pat. Nos. 2852386, 3,062,674, 3,411,911, 3,411,912, 3,142,568, 3,325,286 and 3,547,650 exemplify these polymers including acrylic acid esters such as methyl acrylate, ethyl acrylate, butyl acrylate, iso-butyl acrylate, t-butyl acrylate, 2-hydroxyethyl acrylate and glycidyl acrylate; methacrylic acid esters such as methyl methacrylate, butyl methacrylate, 2-hydroxyethyl methacrylate and glycidyl methacrylate; acrylamides such as acrylamide and N-butyl acrylamide; methacrylamides such as methacrylamide and N-butyl methacrylamide; vinyl esters such as vinyl acetate and vinyl butyrate; halogenated vinyls such as vinyl chloride; halogenated vinylidenes such as vinylidene chloride; vinyl ethers such as vinyl methyl ether; styrenes such as styrene, $\alpha$-methyl styrene and $\rho$-hydroxy styrene; and polymer latexes comprising homo- or co-polymers such as ethylene, propylene, butylene, butadiene, triprene, acrylonitrile, methacrylonitrile, acrylic acid, methacrylic acid and itaconic acid. As for the examples thereof, saponin and the lauryl or oleyl monoethers of polyethylene glycol may be used.

A plural hydrophilic colloidal layers including a backing layer and a protective layer are arranged onto a support surface of a light sensitive material of the invention on which any emulsion coated layer is not provided. If desired, the colloidal layer may also contain a latex, a dye, a mordant, a layer hardener, a surfactant, a pH controller, an antioxidant, a whitening agent, an antistatic agent, a thickener, a matting agent, an auxiliary agent for keeping a developer composition constant and a silver halide material.

The supports applicable to the light sensitive materials of the invention include, for example; a flexible reflection type support made of paper laminated with an $\alpha$-olefin polymer such as polyethylene, polypropylene and an ethylene/butene copolymer or synthetic paper; a flexible supports made of film comprising a semi-synthetic or synthetic macromolecule such as cellulose acetate, cellulose nitrate, polystyrene, polyvinyl chloride, polyethylene terephthalate, polycarbonate and polyamide or made of the above-mentioned film further provided with a reflection layer; and those made of glass, metal or ceramics. Taking the reduction of the weight and the dimensional stability of a support into consideration, it is preferred to use a macromolecular film having a thickness of not thinner than 100 $\mu$m and within the range of, preferably, 175±25 $\mu$m.

For developing the light sensitive materials of the invention, any one of the well-known processes may be used. The developing processes may be either a process for forming a silver image which are the so-called black-and-white developing processes or another process for forming a colored image. In particular, the process is preferably carried out with a lithographic developer applied with a developing agent in which hydroquinone is exclusively used, at a temperature within the range of 20° C. to 40° C. for a time within the range of 20" to 180", when the invention is applied to a lith-type light-sensitive material.

EXAMPLES

EXAMPLE 1

There prepared a silver halide emulsion comprising cubic silver halide grains having a composition of 68 mol % of silver chloride and 32 mol % of silver bromide and having an average grain size of 0.21 $\mu$m, in a functional flow-rate double-jet precipitation method.

The variation coefficient of the grain sizes thereof were 15% of monodispersion type. The variation coefficient is calculated by the equation of $\sigma/\bar{r}$, in which $\sigma$ is a standard deviation of grain size distribution and $\bar{r}$ is an averaged grain size.

The emulsion was added with 10 mg of chloroauric acid and 15 mg of sodium thiosylfate each per mol of the silver halide contained. The resulting emulsion was chemically sensitized at 60° C. for 60 minutes and was then added with 1-methoxyethyl-3-(2-pyridyl)-5-[(3-$\beta$-sulfoethyl-2-benzoxazolidene)]ethylidene-2-thiohydantoin and 3-hydroxyethyl-5-[1-methyl-4-(1H)-pyridylidene]rhodanine each as sensitizing dyes; 6-methyl-4-hydroxy-1,3,3a,7-tetrazaindene, hydroquinone and KBr each as stabilizers; saponin as a spreading agent; and a styrene-maleic acid copolymer having a molecular weight of 2000 as a thickener and, further, with 1.5 g/m$^2$ of a vinyl polymer latex. After that, the resulting emulsion was divided into 12 parts and each of the parts was added with a polyalkylene oxide compound, respectively, as shown in Table 1.

Each of the resulting samples was added with formalin and sodium 2-hydroxy-4,6-dichloro-1,3,5-s-triazine each as hardeners. After that, a backing layer and a backing protective layer were simultaneously multicoated on a polyethylene terephthalate film arranged with each of about 0.1 μm-thick sublayers described in Example 1 given in JP OPI Publication No. 59-19941/1984 to the both surface of the film support; provided that the backing layer was coated with a backing solution that was a 5% gelatin solution prepared by adding the following three kinds of dyes, saponin as a spreading agent and a styrene-maleic acid copolymer as a softener and a thickener;

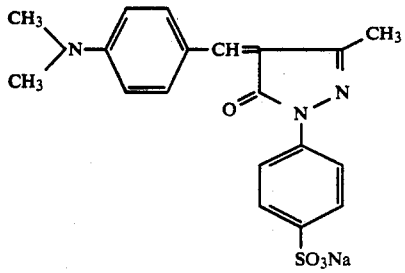

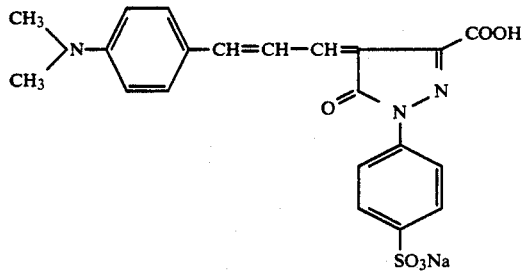

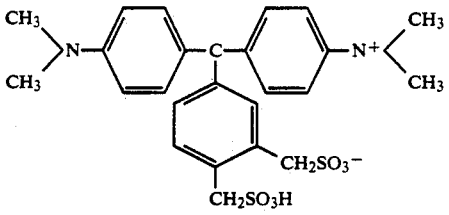

Also provided that the backing protective layer was coated, simultaneously with the backing layer, with a 6% gelatin solution prepared by adding polymethyl methacrylater having an average particle size of 3 μm as a matting agent, sodium 1,2-bis(2-ethylhexyloxy carbonyl)ethane sulfonate as a spreading agent and glyoxal as a hardener.

The coated amounts of gelatin was 3.1 g/m² for the backing layer and 1.0 g/m² for the protective layer, and the resulting coated samples were then dried.

The surface opposite to the backing layer coated surface of the polyethylene terephthalate film supports were coated respectively with the 12 kinds of silver halide emulsions prepared each by adding the polyalkylene oxides as shown in Table 1 into the foregoing silver halide emulsion so that the amount of silver coated could be 3.5 g/m² and the amount of gelatin could be 2.0 g/m² and, further, a 5% gelatin solution added with boron nitride particles having an average particle size of 3.5 μm as a matting agent and sodium 1,2-bis(2-ethylhexyloxy carbonyl)ethane sulfonate as a spreading agent was coated as a protective layer, simultaneously with the above-mentioned 23 kinds of the silver halide emulsions, so that the amount of gelatin could be 1.5 g/m² and then dried up, so that the samples were prepared.

The resulting samples were each cut into test pieces. After exposing the test pieces to light through an optical wedge, they were processed with the developer and fixer having the following formulas through a Konica Automatic Processor Model GL-27 (manufactured by Konica Corp.) at a developing temperature of 32° C. and for a developing time of 60 seconds.

| | |
|---|---|
| <Formula of the developer> | |
| Hydroquinone | 16 g |
| Adducts of formaldehyde and sodium bisulfite | 50 g |
| Potassium sulfite | 4 g |
| Sodium sulfate, anhydrous | 2 g |
| Potassium carbonate | 50 g |
| Sodium carbonate, anhydrate | 5 g |
| Boric acid | 2 g |
| Potassium bromide | 2.5 g |
| Triethylene glycol | 49 g |
| EDTA-2Na | 2 g |
| Diethanol amine | 7 g |
| 5-nitroindazole | 3 mg |
| Polyethylene glycol having an average molecular weight of 1500 | 0.5 g |
| Adjust pH with sodium hydroxide to be | pH 10.20 |
| Add water to make | 1000 ml |
| <Formula of the fixer> | |
| (Composition A) | |
| Ammonium thiosulfate (in an aqueous 72.5% W/V solution) | 240 ml |
| Sodium sulfite | 17 g |
| Sodium acetate, trianhydrate | 6.5 g |
| Boric acid | 6 g |
| Sodium citrate, dihydrate | 2 g |
| Acetic acid (in an aqueous 90% W/W solution) | 13.6 g |
| (Composition B) | |
| Deionized water | 17 ml |
| Sulfuric acid (in an aqueous 50% W/V solution) | 4.7 g |
| Aluminium sulfate (in an aqueous solution of 8.1% W/W converted into an $Al_2O_3$ content) | 26.5 g |

When making use of the fixer, the above-given Compositions A and B were dissolved in this order into 500 ml of water and the resulting solution was made to be 1 liter. The pH of the fixer was proved to be about 4.3.

The samples were evaluated of the sensitivity and 5-graded contrast, pin-hole production, sliding ability and pressure resistance. The results thereof are shown in Table 1. Evaluation grade 3 means a practically applicable limit point; grade 5 means a level where nothing is interfered at all by any troubles; grade 1 means a level where nothing is of practical use at all; and grades 2 and 4 mean each a medium level.

<Evaluation of contrast>

The samples were in-camera exposed to light through a reflective line original pattern and an iodine lamp, at f=16 and for 12 seconds. The resulting exposed samples were developed with developer I at 30.C for 60 seconds through a Konica Automatic Processor Model GQ25 manufactured by Konica Corp., so that the line images were obtained, respectively. The line images were each observed through a 100× magnifier and each of the resulting contrast was visually evaluated by 5 grades.

<Evaluation of pin-hole production>

The resulting black lines each having a line width of 20 μm were observed through a 100× magnifier under then same conditions as in the above-mentioned contrast evaluation, so that the pin-hole production on the developed samples were evaluated by 5 grades.

<Evaluation of sliding ability>

Each of the 2×5 cm sized samples was applied with a 200 g load, so that the friction coefficient thereof was measured.

<Evaluation of pressure resistance>

Each of the samples was brought into pressure contact, by applying a constant pressure of 40 kg/cm$^2$, with a pair of nip-rollers having a mat-surface on one roller and a flat-surface on the other roller ('Art-Roll' manufactured by Schapo Co. After passing each sample between the rollers at a constant speed of 30cm/min, the sample was developed. The degrees of the blackening produced by applying the pressure were evaluated by 5 grades.

TABLE 1

| Sample No. | Polyalkylene oxide compound in emulsion layer: Compound No. | Polyalkylene oxide compound in emulsion layer: Amount added (mg/AgX mol) | Protective layer: Matting agent | Protective layer: Amount added (g/m$^2$) | Relative sensitivity | Contrast | Pin-hole production | Pressure resistance | Friction coefficient | |
|---|---|---|---|---|---|---|---|---|---|---|
| 1 | I-4 | 100 | Boron nitride | 1.2 | 99 | 5 | 5 | 5 | 0.13 | Inv. |
| 2 | II-4 | 100 | Boron nitride | 1.2 | 99 | 5 | 5 | 5 | 0.13 | Inv. |
| 3 | II-3 | 100 | Boron nitride | 1.2 | 99 | 5 | 5 | 5 | 0.13 | Inv. |
| 4 | I-4 | 150 | Boron nitride | 1.5 | 98 | 5 | 5 | 5 | 0.12 | Inv. |
| 5 | II-3 | 40 | Silica | 1.2 | 98 | 3 | 4 | 4 | 0.40 | Comp. |
| 6 | II-3 | 150 | Silica | 1.5 | 96 | 5 | 1 | 4 | 0.46 | Comp. |
| 7 | II-3 | 100 | PMMA | 1.2 | 98 | 5 | 1 | 4 | 0.35 | Comp. |
| 8 | II-3 | 100 | Nylon | 1.2 | 98 | 5 | 2 | 4 | 0.38 | Comp. |
| 9 | II-3 | 100 | Styrene beads | 1.2 | 97 | 5 | 3 | 4 | 0.34 | Comp. |
| 10 | I-4 | 100 | Not used | Not used | 100 | 5 | 5 | 2 | 0.66 | Comp. |
| 11 | II-4 | 100 | Not used | Not used | 100 | 5 | 5 | 2 | 0.66 | Comp. |
| 12 | II-3 | 100 | Not used | Not used | 100 | 5 | 5 | 2 | 0.66 | Comp. |

Inv.: Invention
Comp.: Comparison

As is obvious from Table 1, it is proved that a sample can be obtained from the system where boron nitride of the invention is added as a matting agent into a protective layer and polyalkylene oxide into an emulsion layer so as to reduce the pin-hole production and to provide an excellent high contrast and a pressure resistance.

EXAMPLE 2

A monodisperse type silver iodobromide emulsion having an average grain size of 0.22 μm and a silver iodide content of 2 mol % was prepared in a double-jet precipitation method while keeping the conditions of a reaction vessel to be at 50° C., pAg=8.0 and pH=2. When observing the resulting emulsion through an alectron microscope, it was proved that the twinned crystal production ratio was not more than 1%. The crystals were grown up by serving the resulting emulsion as seed crystals.

While keeping an aqueous gelatin solution to be at 40° C. in a reaction vessel and after adding the seed crystals, pH of the solution was adjusted to be 8.0 with aqueous ammonia and acetic acid. After the pAg was adjusted to be 9.0 with an aqueous potassium bromide solution, a solution of ammoniacal silver ions and a solution of potassium bromide were added in a double-jet precipitation method while the pAg was kept constant. The crystals were then grown up while gradually lowering the pH from 8.0 down to 7.0 with acetic acid.

A silver iodobromide emulsion having an average grain size of 0.35 μm and containing silver iodide of 0.5 mol % was prepared by making the pH and pAg to be 6.0 and 10.5 with a potassium bromide solution and acetic acid, respectively.

A desalting step was carried out so as to remove the excess salts in the following manner.

While keeping the silver halide emulsion solution to be at 40° C., the silver halide grains were precipitated by adding the following Compound (F) to the emulsion solution and the resulting supernatant was then eliminated therefrom. After that, pure water being kept at 40° C. was added. The silver halide grains were precipitated again by adding magnesium sulfate and the resulting supernatant was removed away. The above-mentioned procedures were repeated once more and gelatin was added, so that an emulsion having pH=6.0 and pAg=8.5 could be prepared.

Compound (F)

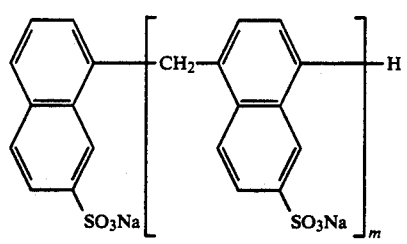

(m represents the polymerization degree)

Three minutes after raising the temperature of the resulting silver halide emulsion up to 57° C., 11 ml of a 0.5% 1-ohenyl-5-mercaptotetrazole solution was added. Another 2 minutes after, 1.4 ml of a 0.2% chloroauric acid solution was added. Further 2 minuted after, 1.3 ml of 0.25% sodium thiosulfate solution was added. After completing the additions, the emulsion was chemically sensitized at 57° C. for 54 minutes.

When completing the chemical sensitization, 240 ml of a 1.2% 6-methyl-4-hydroxy-1,3,3a,7-tetrazaindene solution and 24.3 g of gelatin were added. While gradually lowering the temperature of the silver halide emulsion down to 50° C. and when the temperature thereof was lowered down to 50° C., 70 ml of a 0.25% sensitizing dye (a) solution was added and the resulting solution was maintained at 50° C. for 60 minutes. Next, 2 ml of a 10% sodium carbonate solution was added thereto and the temperature thereof was lowered down to 40° C.

The resulting sensitized emulsion was added with 16 ml of a 5% the following compound (i) solution as a spreading agent, 100 ml of the polymer latex of the following compound (ii), 40 ml of the following compound (iii) as a thickener and 1 g of the following compound (X).

Compound (i)

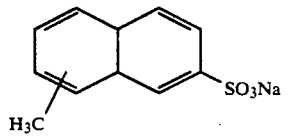

Compound (a)

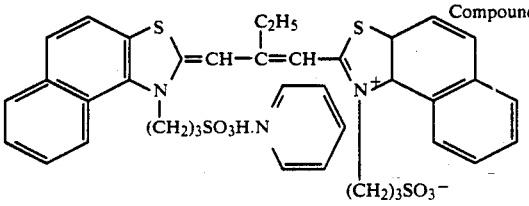

Compound (ii)

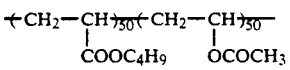

Compound (iii)

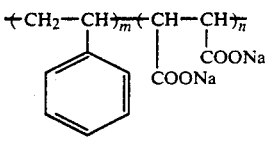

Compound (x)

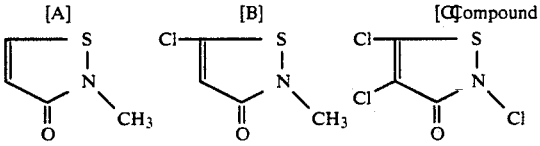

A:B:C = 46:50:4

The amounts of the additives applied to the silver halide emulsion are indicated in terms of an amount per mol of the silver halide used in the emulsion.

The resulting emulsion was coated together with an emulsion protective layer on a subbed 100 μm-thick polyethylene terephthalate support. The emulsion protective layer was prepared by adding 80 ml of 5% formalin and 12 g of amorphous silica having an average particle size of 3.5 μm and further adding the boron nitride of the invention and the following compounds (b), (c) and (d) for the comparative matting agents as shown in Table 2 so that the gelatin content of the resulting emulsion protective layer could be 1.0 g/m$^2$.

In addition to the above, a backing layer was coated on the opposite side of the above-mentioned coated support surface upon adding the following dye (e) could be in an amount of 25 mg/m$^2$ and gelatin content could be in an amount of 3.0 g/m$^2$ and, further, a protective layer was coated thereon upon adding gelatin could be in an amount of 1.2 g/m$^2$ and the sliding agent could be in the amount shown in Table 2.

Comparative compound (b)

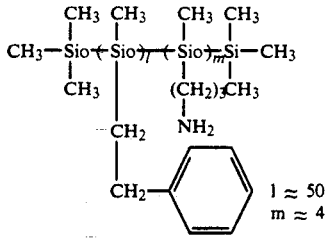

Comparative compound (c)

$n\text{-}C_{15}H_{31}COOC_{16}H_{33}$

Comparative compound (d)

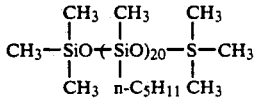

Dye (e)

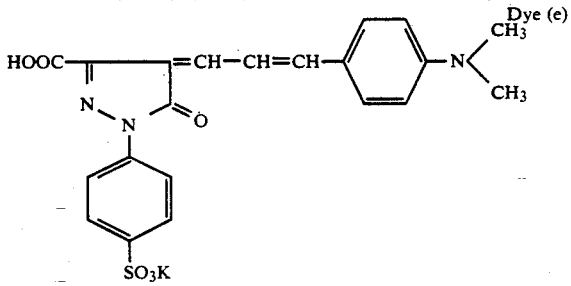

Dye (f)

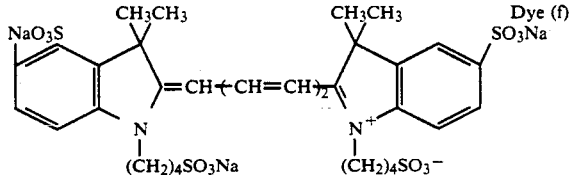

The resulting samples were each evaluated in the following manners.

(Coating aptitude)

The coating aptitude of the coating solutions to the supports were evaluated in the following manner.

After the samples were dried up at a dry bulb temperature of 35° C. and a wet bulb temperature at 18° C., the uniformity of coating surfaces were each evaluated visually through reflected light. On the backing layer side, the surfaces each multicoated thereon with the backing layer and the backing protective layer were subjected of evaluation and, on the emulsion side, the surfaces each having a density of 1.0 were evaluated in the sample exposed to light and processed with Developer CDM-621 and Fixer CFL-851 each manufactured by Konica Corp.

The results of the evaluation were graded by 5 ranks. Grade 1 means the worst and grade 5 means the best. Grade 2 or lower means that the subject sample was difficut to be practically used.

(Evaluation of adhesiveness)

Each sample was cut into 3×13 cm size and the cut pieces were humidity-controlled at 23° C. and 80%RH for 5 hours. Each of the cut pieces was superposed to be about 3 cm in thickness upon a backing layer so as to come into contact with each other. After the sample piece was fasten with a rubber band, it was put and sealed in an air- and moisture-tight envelope. After the sealed envelopes were put in a thermostat chamber at 40° C. for 24 hours, the resulting transfer of the backing dye to the emulsion side was evaluated visually by 5 grades. The 5 grades evaluation was the same as in the above-mentioned coating aptitude evaluation.

(Evaluation of the sliding property)

The same evaluation was made as in Example 1.

The results thereof are shown in Table 2.

TABLE 2

| Sample No. | Emulsion protective layer: Matting agent | Particle size (μm) | Amount added (mg/m²) | Backing protective layer: Matting agent | Particle size (μm) | Amount added (mg/m²) | Uniformity grade: Emulsion side | Backing layer side | Adhesiveness | Static friction coefficient | |
|---|---|---|---|---|---|---|---|---|---|---|---|
| 1 | — | — | — | — | — | — | 4 | 4 | 3 | 0.66 | Comp. |
| 2 | — | — | — | Comparative compound (b) | — | 50 | — | 3 | 1 | 0.40 | Comp. |
| 3 | — | — | — | Comparative compound (c) | — | 50 | — | 3 | 1 | 0.38 | Comp. |
| 4 | — | — | — | Comparative compound (d) | — | 50 | — | 3 | 1 | 0.41 | Comp. |
| 5 | Comparative compound (b) | — | 50 | — | — | — | 3 | — | 1 | 0.40 | Comp. |
| 6 | Comparative compound (c) | — | 50 | — | — | — | 3 | — | 1 | 0.39 | Comp. |
| 7 | Comparative compound (d) | — | 50 | — | — | — | 3 | — | 1 | 0.38 | Comp. |
| 8 | Comparative compound (b) | — | 50 | Comparative compound (b) | — | 50 | 3 | 3 | 1 | 0.36 | Comp. |
| 9 | Comparative compound (c) | — | 50 | Comparative compound (c) | — | 50 | 3 | 3 | 1 | 0.36 | Comp. |
| 10 | Comparative compound (d) | — | 50 | Comparative compound (d) | — | 50 | 3 | 3 | 1 | 0.37 | Comp. |
| 11 | Boron nitride | 5 | 50 | — | — | — | 5 | — | 5 | 0.24 | Inv. |
| 12 | Boron nitride | 5 | 100 | — | — | — | 5 | — | 5 | 0.22 | Inv. |
| 13 | Boron nitride | 5 | 150 | — | — | — | 5 | — | 5 | 0.20 | Inv. |
| 14 | Boron nitride | 8 | 50 | — | — | — | 5 | — | 5 | 0.22 | Inv. |
| 15 | Boron nitride | 8 | 100 | — | — | — | 5 | — | 5 | 0.21 | Inv. |
| 16 | Boron nitride | 8 | 150 | — | — | — | 5 | — | 5 | 0.18 | Inv. |
| 17 | — | — | — | Boron nitride | 5 | 50 | — | 5 | 5 | 0.18 | Inv. |
| 18 | — | — | — | Boron nitride | 5 | 100 | — | 5 | 5 | 0.18 | Inv. |
| 19 | — | — | — | Boron nitride | 5 | 150 | — | 5 | 5 | 0.18 | Inv. |
| 20 | — | — | — | Boron nitride | 8 | 50 | — | 5 | 5 | 0.16 | Inv. |
| 21 | — | — | — | Boron nitride | 8 | 100 | — | 5 | 5 | 0.16 | Inv. |
| 22 | — | — | — | Boron nitride | 8 | 150 | — | 4 | 5 | 0.16 | Inv. |
| 23 | Boron nitride | 5 | 50 | Boron nitride | 5 | 50 | 5 | — | 5 | 0.13 | Inv. |

Comp.: Comparison
Inv.: Invention

It can be proved from the results shown in Table 2 that the samples of the invention can be remarkably improved in coatability, adhesiveness and sliding property.

What is claimed is:

1. A silver halide photographic light-sensitive material comprising a support having, on a side of said support, a silver halide emulsion layer and a protective layer provided on said silver halide emulsion layer, and on the other side of said support, a backing layer and a protective layer provided on said backing layer, and at least one of said protective layer of said silver halide emulsion layer and said protective layer of said backing layer contains particles comprising boron nitride.

2. The light-sensitive material of claim 1, wherein said boron nitride particles have an average size of 1 to 10 μm.

3. The light-sensitive material of claim 2, wherein said boron nitride particles have an average size of 2 to 5 μm.

4. The light-sensitive material of claim 1, wherein said boron nitride particles are contained in said protective layer in an amount of from 5 mg/m² to 1000 mg/m².

5. The light-sensitive material of claim 4, wherein said boron nitride particles are contained in said protective layer in an amount of from 20 mg/m² to 200 mg/m².

6. The light-sensitive material of claim 1, wherein said silver halide emulsion layer comprises a polyalkylene oxide compound and a silver halide emulsion containing cubic silver halide grains having a (100) surface prepared under a condition with a pH value of 5 to 7, a silver chloride content of not less than 50 mol % and silver halide grains having an average grain size of not more than 0.5 μm.

7. The light-sensitive material of claim 6, wherein said polyalkylene oxide is one represented by the following formula I or II;

$$HO(CH_2CH_2O)_{n_1}(CH_2\underset{\underset{CH_2OR_1}{|}}{CHO})_{m_1}-(R_2)_l-(CH_2\underset{\underset{CH_2OR_1}{|}}{CHO})_{m_2}(CH_2CH_2O)_{n_2}H$$

wherein $R_1$ is an alkyl group having 2 to 4 carbon atoms; $R_2$ is an alkylene group having 2 to 4 carbon atoms; 1 is an integer of zero to 5; $m_1+m^2$ is an integer of 2 to 20; and $n_1+n_2$ is an integer of 5 to 50, $$R_3-A-O-(CH_2CH_2O)nH \qquad \text{Formula II}$$

wherein $R_3$ is an alkyl group having 6 to 20 carbon atoms; A is an aromatic group which may have an substituent other than the group of $R_3$; and n is an integer of 13 to 50.

8. The light-sensitive material of claim 7, wherein said polyalkylene compound of formula I is contained in said silver halide emulsion layer an amount of from 25 mg to 5 g per mol of silver contained in said emulsion layer.

9. The light-sensitive material of claim 7, wherein said polyalkylene compound of formula II is contained in said silver halide emulsion layer in an amount of from 6 mg to 6 g per mol of silver contained in said emulsion layer.

10. The light-sensitive material of claim 8 wherein said boron nitride particles have an average size of 1 to 10 μm and are contained in said protective layer in an amount of from a 5 to mg/m$^2$ to 1000 mg/m$^2$.

11. The light-sensitive material of claim 8 wherein said boron nitride particles have an average size of 2 to 5 μm, and are contained in said protective layer in an amount of 20 mg/m$^2$ to 200 mg/m$^2$.

12. The light-sensitive material of claim 11 wherein the amount of boron nitride is 50 to 80 mg/m$^2$.

13. The light-sensitive material of claim 9 wherein said boron nitride particles have an average size of 1 to 10 μm and are contained in said protective layer in an amount of from 5 mg/m$^2$ to 1000 mg/m$^2$.

14. The light-sensitive material of claim 9 wherein said boron nitride particles have an average size of 2 to 5 μm, and are contained in said protective layer in an amount of 20 mg/m$^2$ to 200 mg/m$^2$.

15. The light-sensitive material of claim 14 wherein said amount of Boron nitride is 50 to 80 mg/m$^2$.

* * * * *